US006351913B1

(12) United States Patent
Freiborg et al.

(10) Patent No.: US 6,351,913 B1
(45) **Date of Patent: *Mar. 5, 2002**

(54) FOLDED RIDGE COVER AND METHOD OF FABRICATION

(75) Inventors: Mark Freiborg, Huntington Beach; Bennie Freborg, Flintridge, both of CA (US)

(73) Assignee: The Dorothy and Ben Freiborg 1980 Trust, Flintridge, CA (US); by said Ben Freiborg ( * ) Notice: Subject to any disclaimer, the term of this patent is extended or adjusted under 35 U.S.C. 154(b) by 0 days.

This patent is subject to a terminal disclaimer.

(21) Appl. No.: 09/433,810

(22) Filed: Nov. 3, 1999

Related U.S. Application Data

(63) Continuation-in-part of application No. 09/264,155, filed on Mar. 5, 1999.

(51) Int. Cl.[7] ..... E04D 1/30

(52) U.S. Cl. ..... 52/57; 52/276; 52/518; 52/557; 52/559; 52/745.19

(58) Field of Search ..... 52/57, 518–560

(56) References Cited

U.S. PATENT DOCUMENTS

| | | | | |
|---|---|---|---|---|
| 3,913,294 A | | 10/1975 | Freiborg | |
| 4,434,589 A | | 3/1984 | Freiborg | |
| 4,439,955 A | * | 4/1984 | Freiborg | 52/57 |
| 4,447,500 A | * | 5/1984 | Ferris | 428/489 |
| 4,824,880 A | * | 4/1989 | Algrim et al. | 524/62 |
| 4,897,293 A | * | 1/1990 | Thessen | 428/40 |
| 4,923,913 A | * | 5/1990 | Chich et al. | 524/62 |
| 5,094,042 A | | 3/1992 | Freborg | |
| 5,295,340 A | | 3/1994 | Collins | |
| 5,319,898 A | | 6/1994 | Freiborg | |
| 5,365,711 A | | 11/1994 | Pressutti | |
| 5,375,388 A | | 12/1994 | Poplin | |
| 5,377,459 A | | 1/1995 | Freiborg | |
| 5,471,801 A | | 12/1995 | Kupczyk | |
| 5,685,117 A | | 11/1997 | Nicholson | |

* cited by examiner

*Primary Examiner*—Carl D. Friedman
*Assistant Examiner*—Bennett Porterie
(74) *Attorney, Agent, or Firm*—Blakely, Sokoloff, Taylor & Zafman LLP

(57) ABSTRACT

An asphalt composition ridge cover and method of forming the same whereby a decorative appearance somewhat resembling that of a shake roof ridge cover is achieved. The ridge cover generally is a pair of flat, approximately rectangular pieces of asphalt composition roofing material, having a plurality of tabs at one end of each piece which are folded over one another thereby forming a region of increased thickness at that end. The two pieces are adhesively joined in a plurality of areas including an area disposed to both sides of the central fold that forms the ridge line of ridge cover when installed, thereby holding the ridge cover in a folded configuration. The adhesive may contain a solid filler to increase the thickness of the ridge cover. The adhesive joining in the vicinity of the central folding inhibits further bending along the central fold and thereby reduces cracking. When installed, the thickened portions give the ridge covers, and the ridge on which they are installed, the appearance of a shake shingle or tile roof while maintaining double coverage as required in many installations. The shape and construction of the folded ridge cover allows the folded covers to be economically packed for shipping. One particular shape of the unfolded cover pieces permits a very economical cutting of such covers from rectangles of asphalt composition material of industry standard dimensions.

43 Claims, 4 Drawing Sheets

FOLDED RIDGE COVER AND METHOD OF FABRICATION

CROSS-REFERENCE TO RELATED APPLICATIONS

This application is a continuation-in-part of application Ser. No. 09/264,155 filed Mar. 5, 1999.

BACKGROUND OF THE INVENTION

1. Field of the Invention

This invention relates to the field of roofing, and more particularly to roof ridge, hip, and rake covers.

2. Prior Art

Various types of roofing and, in particular, ridge covers, are well known in the prior art. In general, the ridge cover selected for use on a particular roof is selected in conjunction with the shingle or other roof covering, as part of the roofing system. Consequently, in the following discussion of the prior art, the considerations in choice of the roofing system will be described, it being understood that a ridge cover is generally selected for comparability in appearance and installation with a complete roofing system. Also, the present invention ridge cover is particularly advantageous because of its appearance and, therefore, the following discussion of prior art is limited to those applications where appearance is a substantial consideration.

Prior art roofing systems include asphalt composition shingles, tile roofs, rock roofs (decorative rock scattered over an asphalt covered asphalt composition sheet) and shake roofs. In general, each of these types have certain features and disadvantages and the choice for any particular installation is generally a compromise to achieve the desired results. By way of example, a tile roof may be a very attractive roof, but it is both an expensive and a heavy roofing material, typically weighing as much as 900 pounds per 100 square feet. The weight of such roofs may require that the roof structure itself be increased over that which would be used with another type of roofing material and, consequently, the cost associated with tile roofs may include an incremental cost due to the increases of structural requirements in the building itself. Such roofs, however, are both durable and attractive and are used where these are prime considerations. Also, in some areas of the country where there is a substantial hazard of fire due to hot ashes originating from nearby brush fire such roofs are used because they are fire proof.

Rock roofs are often used for homes in some parts of the country and are a reasonable good compromise between cost and appearance. This type of roof is generally limited to low pitch roofs since the rocks are not all physically secured to the underlying asphalt. Also, the rocks tend to become scattered with time because of the effects of high winds, heavy rains or the sweeping effect of branches on neighboring trees and, therefore, must be replaced or replenished occasionally to maintain the desired appearance.

Shake roofs are roofs made up of tapered wooden strips nailed to the roof much like shingles and are popular in parts of this country because of their highly attractive appearance and because they esthetically conform to many types of building construction. This type of roof is somewhat less expensive than a tile roof and is much lighter, characteristically having weights of approximately 450 pounds per 100 square feet. However, such a roof is not as durable as most other types of roofs since it is subjected to deterioration from environmental exposure and the individual wooden members are apt to crack when walked on, and to thereafter leak. Furthermore, unless specially treated such roofs are highly inflammable and create a substantial fire hazard whenever the roof may be exposed to hot ashes originating from a neighboring fire.

An asphalt composition roof made up of individual shingles is a relatively durable, light-weight and inexpensive roof. Such a roof may have a weight of approximately 235 pounds per hundred square feet and is fairly easily and quickly installed. The asphalt is not easily ignited and fire resulting from hot ashes falling on the roof is further inhibited by the granular surface on such roofs. However, this type of roof is a very flat and bland type of roof, the shingles having little thickness and distinctive character to create an attractive appearance. Though such shingles may be made with a variety of color granules on the surface, thereby creating a reasonable choice of colors for the final roof, and the individual shingles create a reasonably attractive pattern on the roof, such a roof is a roof with pattern and color without dimension, since the individual shingles are only on the order of one-eighth to three-sixteenths of an inch thick, and little depth or dimension is given by the overlap of one shingle by another. Consequently, though the appearance is the only substantial negative factor associated with such roofs, they are not commonly used in installation where considerations of appearance outweigh considerations of cost.

SUMMARY OF THE INVENTION

The present invention is employed in the fabrication of asphalt composition ridge covers to create an appearance similar to that of a shake shingle roof. The invention generally comprises a ridge cover which is formed by folding a plurality of tabs of a pair of unfolded ridge covers over one another to create a ridge cover which gradually thickens as one proceeds from the back of the ridge cover toward the front of the ridge cover.

The first ridge cover is placed on the roof ridge in a normal manner. The second ridge cover is placed on the first such that the front end is set back about eight inches from the front end of the first ridge cover. Each additional ridge cover is deployed in a manner similar to the preceding ridge cover. The ridge covers appear, at the exposed end, about 5 to 7 times as thick as the conventional asphalt shingle, creating an attractive appearance by adding a dimensional characteristic to the ridge cover while maintaining full double coverage. A suitable adhesive may be used to facilitate installation.

In the presently preferred embodiment, the increased thickness is formed by folding multiple tabs on one end of each of two pieces which are placed and sized such that when all folds are completed, the desired thickened end is produced. The two pieces are adhesively joined to maintain the desired configuration of the folded tabs and to provide adhesive joining along the longitudinal centerline of the ridge cover. The assembled ridge cover is bent along its longitudinal centerline to form about a ninety degree angle. When the longitudinal bend is completed, the ridge cover then has the proper shape for installation on a ridge. A solid filler material, such as ground rubber particles, may be mixed with the adhesive so that the adhesive joint increases the thickness of the assembled ridge cover. The adhesive joining of the two pieces in the centerline region tends to hold the fold and prevent further sharp bending at the centerline fold during installation, which reduces the occurrence of cracking along the centerline fold.

The shape and construction of the folded ridge cover allows the folded covers to be economically packed for shipping. One particular shape of the unfolded cover pieces permits a very economical cutting of such covers from rectangles of asphalt composition material of industry standard dimensions.

DETAILED DESCRIPTION OF THE INVENTION

Figure 1:
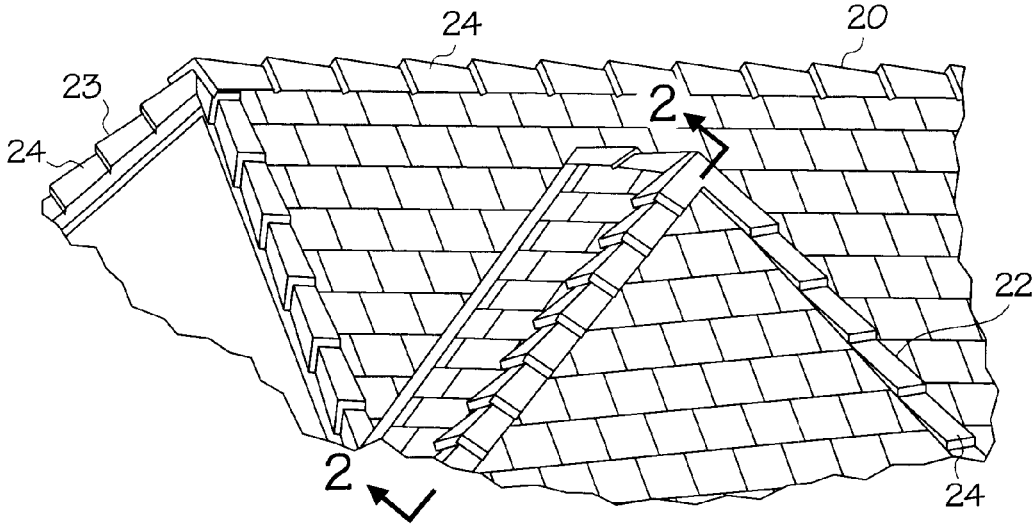
FIG. 1 is a drawing of a portion of a building roof illustrating the appearance of the ridge cover of the present invention.
Figure 2:
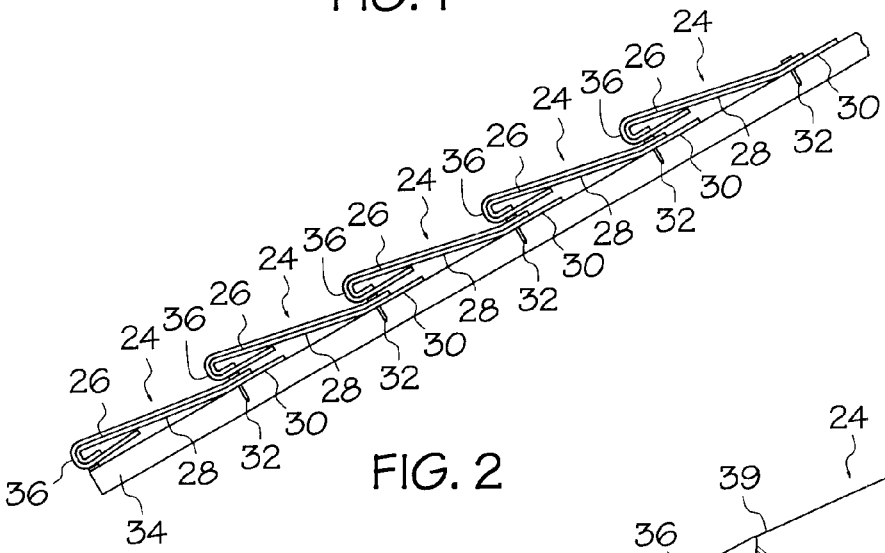
FIG. 2 is a cross section taken along line 2—2 of FIG. 1.

First referring to FIG. 1, an illustration of the present invention ridge cover, as installed on a typical roof, may be seen. It is to be understood that the phrase ridge cover, as used herein, is used in the broad sense to include hip covers, rake pieces, and the like, and is used merely as a convenient phrase for identifying all such covers. It may be seen that the ridge 20, hip 22, and rake 23 are characterized by a pleasant physical appearance as a result of the raising of the outward extending end of the ridge covers to provide an appearance more like a shake roof ridge cover. The manner in which this is achieved in the preferred embodiment is illustrated in FIG. 2, which is a cross section taken along line 2—2 of FIG. 1.

Each ridge cover 24 is comprised of a front end portion 26, a middle portion 28 and a back end portion 30. When folded, the ridge cover is approximately 11½ inches long and each side of the ridge cover is approximately 4 inches wide. When installed, the front end portion 26 of a second ridge cover 24 is placed over the back end portion 30 of a first ridge cover 24 so as to cover the nails 32 used to secure the first ridge cover at its back end portion 30 to the roof 34. Thus no nails 32 are left exposed. Typically, the front edge 36 of the second ridge cover 24 is set back approximately 8 inches from the front edge 36 of the first ridge cover. Successive ridge covers 24 are installed upward along a ridge 20 in a similar manner.

Figure 3:
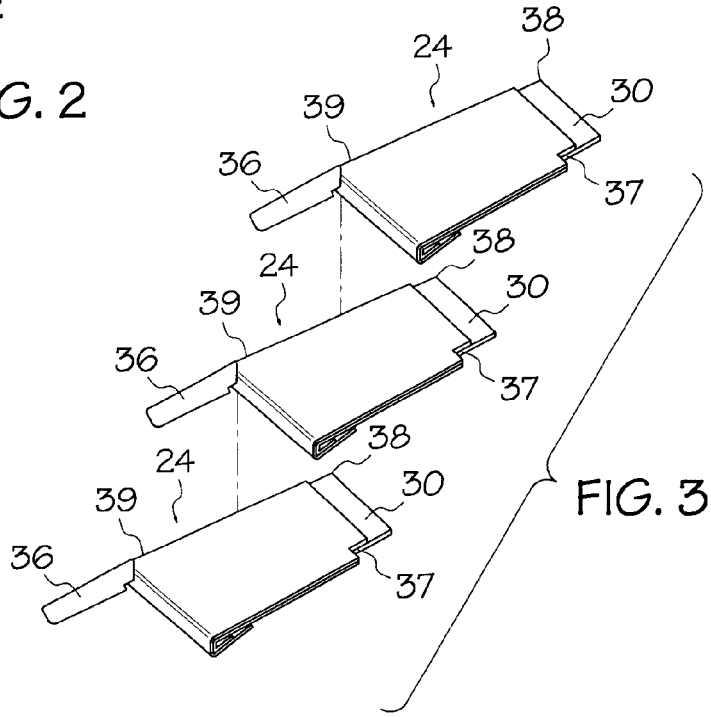
FIG. 3 is an illustration of three ridge covers shown in an exploded view to illustrate the manner in which each ridge cover is located with respect to another ridge cover.

A perspective of one embodiment of a finished ridge cover 24 is shown in FIG. 3 clearly illustrating the smooth curved front edge 36 of each ridge cover. A notch 37 is provided at each corner of the back end portion 30. The function of these notches 37 is partly cosmetic. Without the notch 37, the rear corners of a lower ridge cover would project sideways out from under the front edge 36 of the next ridge cover up the ridge. The notch 37 eliminates the unappealing projections. The notch 37 also serves as a guide to the roofer as to how far one ridge cover should overlap the other i.e., the distance from notch 37 to the front edge 36 is about 8.2 inches. The front edge 36 of one ridge cover should be installed so that it sits on the lower ridge cover at the lower end of a notch 37. This notch 37 eliminates the need for the roofer to measure, gauge or estimate overlap. The resulting overlap is uniform along the entire ridge 20.

The thickness of each ridge cover 24 gradually decreases toward the back end portion 30 where the ridge cover 24 is as thick as a single sheet of conventional asphalt composition material. A ridge bend 39 in the ridge cover 24 of approximately ninety degrees is located along the longitudinal centerline 38 of each ridge cover. The ridge bend 39 gives the ridge cover 24 a pleasing appearance and permits the ridge cover to straddle the ridge 20 of the roof 34 and also lie in contact with the roof on both sides of the ridge 20. Because of the unique method of fabricating the ridge cover 24 as herein disclosed, the ridge bend 39 is fixed during fabrication. The angle between the two sides of the ridge cover 24 may be adjusted during installation so that the ridge cover fits closely to the roof. Because the ridge bend 39 is substantially fixed, the adjustment of the sides is accomplished by introducing curves 42 of substantial radius in the sides as may be seen in FIG. 9. This reduces sharp bending of the ridge cover during installation and reduces the occurrence of cracking along the ridge bend 39. The ridge cover 24 is stored and shipped with the approximately ninety degree ridge bend 39 along the centerline 38. In the fully fabricated and bent condition, the ridge cover 24 is substantially rigid. Ridge covers 24 can be stacked in a nested fashion in alternating directions so that the front portion 26 of one ridge cover 24 is stacked on top of the back end portion 30 of the next ridge cover 24. Ridge covers 24 so stacked are largely self protecting and only minimal additional packaging is required to hold them together for storage or shipping.

Figure 11:
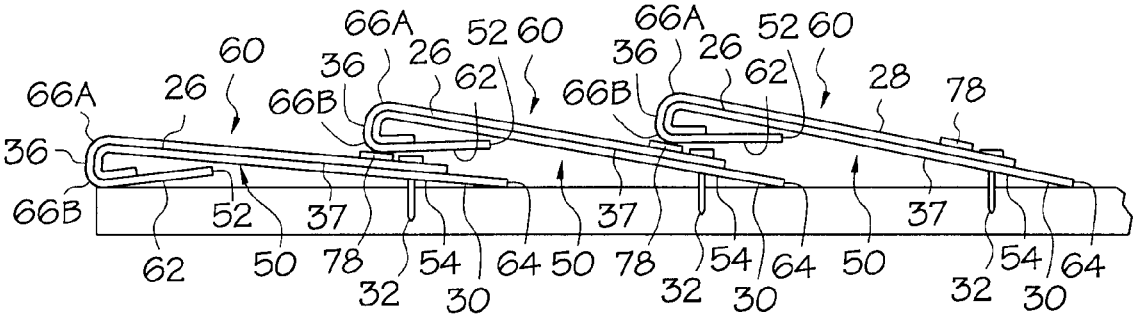
FIG. 11 shows the installation of the preferred embodiment of the ridge cover of the present invention.

The detailed cross sectional view of the ridge cover 24 in FIG. 11 shows the manner of providing increased thickness at the front end portion 26. The manner of assembly and folding provides for four thicknesses reducing to three thicknesses at the front end portion 26, two thicknesses in the middle portion 28 and a single thickness at the back end portion 30. A smooth curved front edge 36 is also provided by reason of the folding method disclosed herein.

Figure 4A:
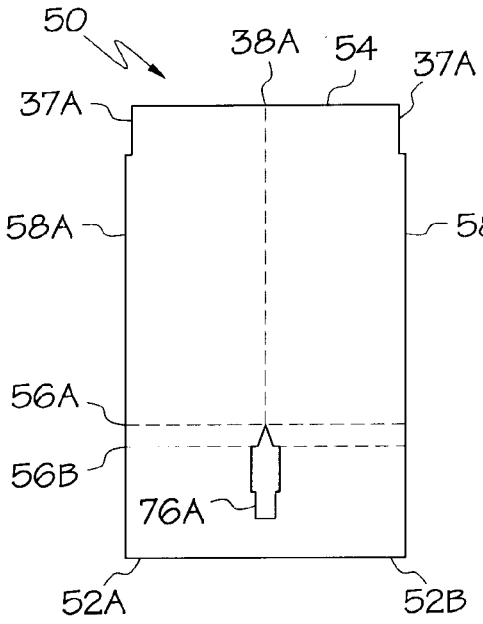
FIG. 4 shows the configuration of the pieces used to fabricate a ridge cover of the present invention.
Figure 4B:
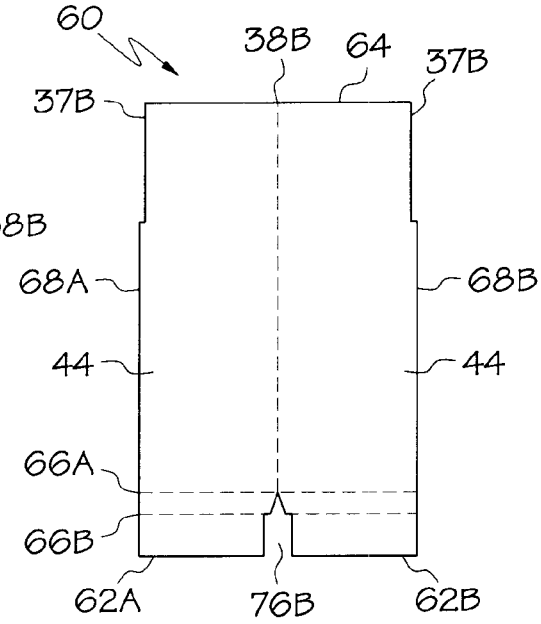

Each ridge cover 24 is fabricated from two generally rectangular pieces of roofing material, a top piece 50 and a bottom piece 60, which may be seen in plan view in FIG. 4*a* and 4*b*. Both pieces 50, 60 have the same general configuration including two foldable tabs 52*a*, 52*b*, 62*a*, 62*b*, at one end 56, 66 of the central portion of the piece 50, 60 and a central tab defined by notches 37*a*, 37*b* at the opposite end of the central portion. The foldable tabs 52*a*, 52*b* of the top piece may be joined where they meet along the centerline in the vicinity of the edge of the roofing material as shown so that the tabs will not splay outwardly when installed. Each piece has a central notch 76*a*, 76*b* designed to permit folding as later described. The roofing material may be any generally flat, flexible material suitable for roofing applications including, but not limited to, asphalt impregnated felt composition, fiberglass materials, rubberized compositions, and composites with various modifiers to improve flexibility and durability. One or both pieces of roofing material may have a crushed rock surface.

Figure 5A:
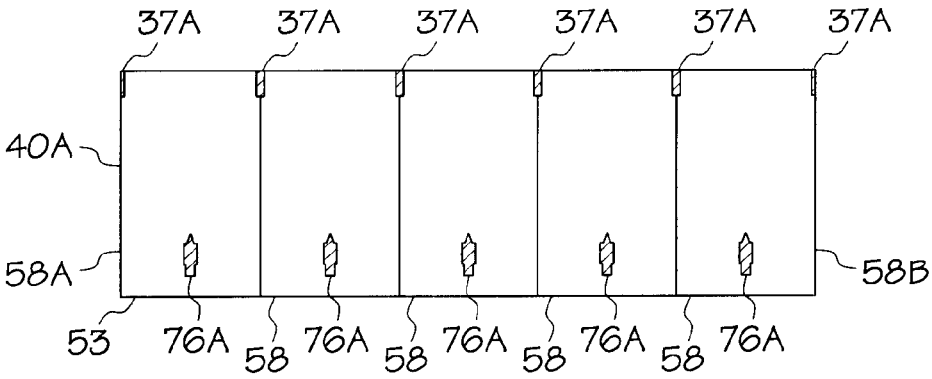
FIG. 5 is a rectangle of asphalt composition material showing the layout for cutting multiple ridge covers therefrom.
Figure 5B:
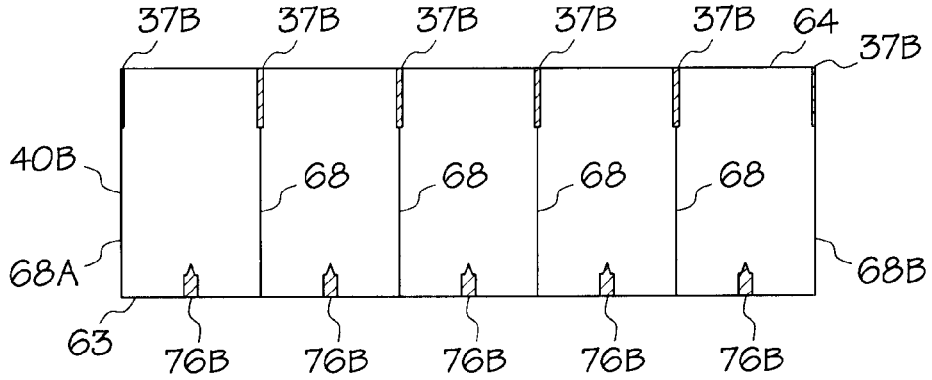
Figure 6:
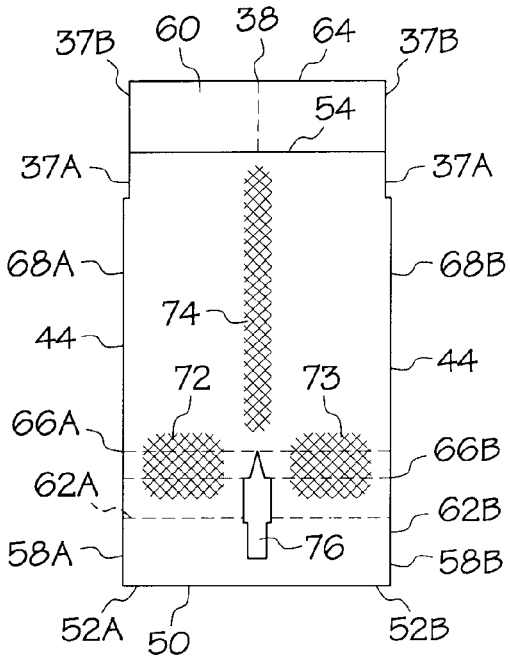
FIG. 6 shows the configuration of the unfolded ridge cover of the present invention.

The top piece 50 and the bottom piece 60 are cut from the parent sheet 40. As shown in FIG. 5*a* and 5*b*, one particular embodiment of the invention allows five pieces 50, 60 to be efficiently cut from a parent sheet 40 that is a rectangle of asphalt saturated felt cut to an industry standard dimension approximately 13¼ by 39¼ inches. The minimal waste material, shown by hatched lines in FIG. 5*a* and 5*b*, is cut away, such as by die cutting. Fabrication of the ridge cover 24 is preferably carried out with the asphalt composition roofing 40 at an elevated temperature, preferably about 100° F., to allow bending without cracking.

Adhesive is applied to the underside of the top piece 50 substantially in the locations shown by cross-hatching in FIG. 6 72, 73, 74. Solid filler particles, such as ground rubber particles, may be added to the adhesive to increase the thickness of the assembly. A suitable filler can be made from used vehicle tires, crushed rock, cut scrap roofing material, or used roofing. One method for adding the solid filler is applying the adhesive to the piece, spreading solid filler particles over the piece, and then removing the loose particles. For example, loose particles may be removed by blowing air on the piece.

The top piece 50 is then assembled to the bottom piece 60 such that the sides 58*a*, 58*b*, 68*a*, 68*b* and notches 37*a*, 37*b* of the two pieces 50, 60 are substantially in alignment and the front end 52 of the top piece 50 projects forward from the front end 62 of the bottom piece 60 by approximately 1 inch. In one embodiment of the method of fabrication, a plurality of top pieces 60 are joined to a like plurality of bottom pieces 50 and the following folding operations are preferably completed before individual assemblies are slit apart along the side lines 58, 68 shown in FIG. 5*a* and 5*b*.

Figure 7A:
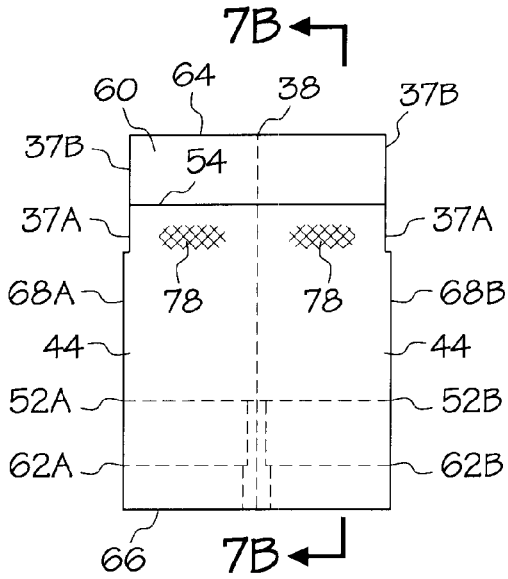
FIG. 7 shows the first folds made to the ridge cover of FIG. 6.
Figure 7B:
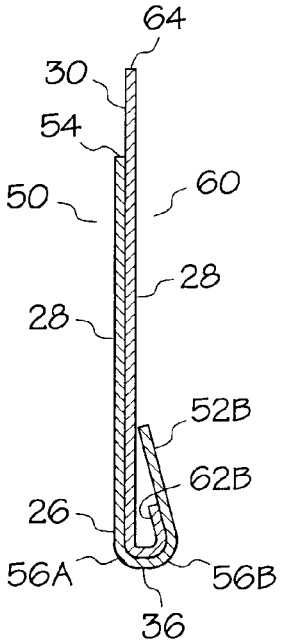
Figure 7C:
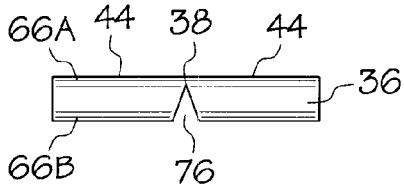

The foldable tabs 52*a*, 52*b*, 62*a*, 62*b* are folded over to form the thickened end 36 of the ridge cover as shown in FIG. 7*a*, 7*b*, and 7*c*. After folding, the front edges of the foldable tabs 52*a*, 52*b* of the top piece 50 will be in contact or nearly in contact with the underside of the middle portion 28 of the bottom piece 60 as may be seen in FIG. 7*b*. Preferably, the tabs are bent at approximately ninety degrees along two crease lines 66*a*, 66*b* that are spaced apart by some distance, preferably ⅜ to ¾ of an inch, to form the front edge 36 of the ridge cover as may be seen in FIG. 7*b* and 7*c*. In the embodiment where a plurality of pieces have been folded while joined, the pieces are now slit apart to form a plurality of assemblies.

Figure 8:
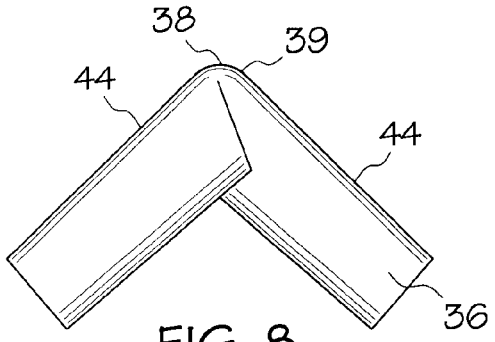
FIG. 8 shows the final fold made to the ridge cover of FIG. 6.

Finally, the assembly is bent to approximately ninety degrees along the centerline 38 to form the ridge bend 39 as may be seen in FIG. 8. The folding and bending operations are carried out before the adhesive sets to allow the top piece 50 to slide over the bottom piece 60 to accommodate the differing radii of bending between the two pieces 50, 60. The composition material is preferably at an elevated temperature increasing the pliability of the material. When the adhesive sets and the material cools, the bends, and particularly the ridge bend 39, are substantially fixed as fabricated. Because the ridge bend 39 is substantially fixed, any adjustment of the ridge cover 24 to fit the roof is accomplished by introducing curves 42 of substantial radius in the sides 44 of the roof cover 24 as may be seen in FIG. 9. This reduces sharp bending of the ridge cover 24 along the ridge bend 39 during installation and reduces the occurrence of cracking at the time of installation and in service.

Figure 10:
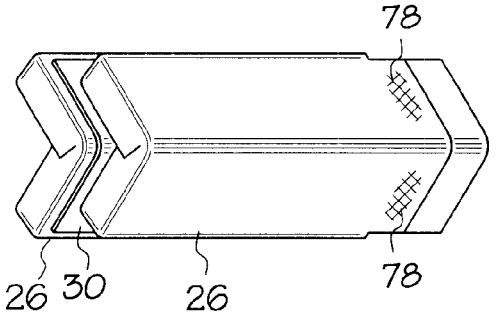
FIG. 10 is a drawing of three ridge covers in a stacked configuration for storage or shipping.

Once the final fold has been made and the ridge cover 24 has taken on the form shown in FIG. 8, the ridge cover 24 is prepared for shipment and installation. The unique method of fabrication produces a ridge cover 24 that is substantially rigid and largely self protecting. Finished ridge covers can be stacked in a nested fashion with the ridge bend 39 of one ridge cover 24 placed on top of the ridge bend 39 of the ridge cover 24 below as shown in FIG. 10. The ridge covers are stacked with the front portion 26 of one ridge cover 24 being stacked above the back end portion 30 of the ridge cover 24 below. In this way, the single thickness back end portion 30 of one ridge cover 24 is protected by the more rigid front portions 26 of the adjacent ridge covers 24. This arrangement also produces a straight stack by offsetting the tapers of the ridge covers 24. With this stacking arrangement, the finished ridge covers are inexpensively packaged for storage and shipment.

Figure 9:
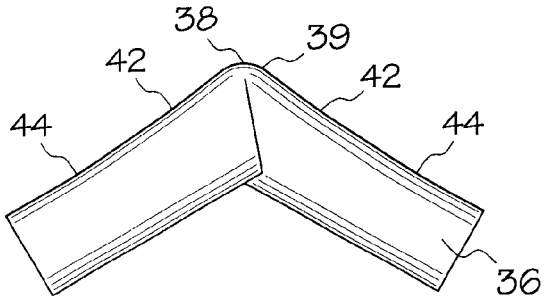
FIG. 9 shows the adjustment of the ridge cover during installation.

The rigidity of the ridge cover 24 created by the adhesive joining of the top piece 60 and the bottom piece 50 in proximity to the ridge bend allows the ridge covers to be installed by nailing or stapling without use of adhesives. If desired, two regions of adhesive 74 may be used on the underside of the front end portion 26 as shown in FIG. 11. Such an adhesive 74 may be provided in the fabricated ridge cover by applying an adhesive 74 that will flow when heated by the sun's warmth to adhere the front end portion 26 of one ridge cover to the back end portion 30 of an underlying ridge cover as shown in FIG. 8 and 9. A release film 75 may be applied to the adhesive 74, such as a release film in the form of a tape. The essential feature of the release film 75 is that it adhere to and yet be readily releasable from contact with the adhesive 74. The release film 75 is used to prevent the adhesive 74 from adhering to the back end portion 30 of an underlying ridge cover when in the packed position. The release film 75 is readily separated from the adhesive 74 prior to installation. Each ridge cover is secured by nails 32 as shown in FIG. 11. The nails are driven through the double thickness portion of the ridge cover 24 in the area that will be covered by the next ridge cover 24. The rear edge 54 of the central tab portion of the top piece 50 is located about 2 inches to the rear of the corner of the notches 37 to provide 2 inches of double thickness within which the nails should be driven.

There has thus been provided a pair of novel shaped asphalt composition pieces which have a number of tabs that when properly joined and folded produce a ridge cover of increased thickness at its front edge. The shape of the pieces are carefully chosen so that a series of such pieces may be economically cut from flat sheets of asphalt composition material of an industry standard size with minimal waste. While the description of the preferred embodiment has been with specific reference to FIGS. 1–11, it should be understood that various modifications, additions and substitutions may be made to the structure and method of the invention without departing from the spirit and scope of the invention as defined in the appended claims.

What is claimed is:

1. A ridge cover comprising:

a generally rectangular first sheet of roofing material having a first end, a second end, a first edge, a second edge, and a first central portion having a first longitudinal centerline;

a first foldable tab integrally formed with said first end extending from proximate said first longitudinal centerline to proximate said first edge and folded back upon said first central portion;

a second foldable tab integrally formed with said first end extending from proximate said first longitudinal centerline to proximate said second edge and folded back upon said first central portion;

a generally rectangular second sheet of roofing material having a third end, a fourth end, a third edge, a fourth edge, and a second central portion having a second longitudinal centerline, said second longitudinal centerline being adjacent to said first longitudinal centerline;

a third foldable tab integrally formed with said third end extending from proximate said second longitudinal centerline to proximate said third edge and folded back upon said first central portion; and a fourth foldable tab integrally formed with said third end extending from proximate said second longitudinal centerline to proximate said fourth edge and folded back upon said first central portion.

2. The ridge cover according to claim 1 wherein said third foldable tab is joined to said first foldable tab, and said fourth foldable tab is joined to said second foldable tab.

3. The ridge cover according to claim 2 further comprising an adhesive that joins said third foldable tab to said first foldable tab, and said fourth foldable tab to said second foldable tab.

4. The ridge cover according to claim 3 further comprising solid filler particles mixed with the adhesive.

5. The ridge cover according to claim 4 wherein the solid filler particles include at least one of rubber particles, crushed rock, and ground roofing material.

6. The ridge cover according to claim 1 wherein said first foldable tab and said second foldable tab are folded at a pair of spaced apart creases.

7. The ridge cover according to claim 1 wherein the lengths of said first and second foldable tabs are less than the lengths of said third and fourth foldable tabs.

8. The ridge cover according to claim 1 wherein said roofing material comprises asphalt composition material.

9. The ridge cover according to claim 1 wherein said roofing material comprises fiberglass material.

10. The ridge cover according to claim 1 wherein said roofing material comprises rubberized material.

11. The ridge cover according to claim 1 further comprising a first central tab integrally formed with said second end and having a width slightly less than the width of said first central portion and a second central tab integrally formed with said fourth end and having a width slightly less than the width of said second central portion.

12. The ridge cover according to claim 11 wherein said first and second central tabs are each provided with a pair of notches for indicating the required extent of overlap of one ridge cover by the adjacent ridge cover when installed on a ridge.

13. The ridge cover according to claim 11 wherein said first central tab is longer than said second central tab.

14. The ridge cover according to claim 1 wherein the first sheet of roofing material is substantially the same size as the second sheet of roofing material.

15. A method of fabricating a ridge cover comprising:

providing a generally rectangular first sheet of roofing material having a first end, a second end, a first edge, a second edge, and a first central portion having a first longitudinal centerline;

forming in said first sheet a first foldable tab integrally formed with said first end extending from proximate said first longitudinal centerline to proximate said first edge;

forming in said first sheet a second foldable tab integrally formed with said first end extending from proximate said first longitudinal centerline to proximate said second edge;

providing a generally rectangular second sheet of roofing material having a third end, a fourth end, a third edge, a fourth edge, and a second central portion having a second longitudinal centerline, said second longitudinal centerline being adjacent said first longitudinal centerline;

forming in said second sheet a third foldable tab integrally formed with said third end extending from proximate said second longitudinal centerline to proximate said third edge;

forming in said second sheet a fourth foldable tab integrally formed with said third end extending from proximate said second longitudinal centerline to proximate said fourth edge;

joining said first piece and said second piece such that said first piece is substantially below said second piece, said first edge is proximate said third edge, said second edge is proximate said fourth edgesa folding said first and third foldable tabs such that the end of said third foldable tab is proximate a first portion of said first central body portion;

folding said second and fourth foldable tabs such that the end of said fourth foldable tab is proximate a second portion of said first central body portion;

whereby said third end is provided with increased thickness relative to said fourth end

16. The method according to claim 15 wherein said forming of said third and fourth foldable tabs is such that said third foldable tab is joined to said first foldable tab, and said fourth foldable tab is joined to said second foldable tab.

17. The method according to claim 15 wherein said folding of said first foldable tab and said second foldable tab is such that said first foldable tab and said second foldable tab are folded along a pair of spaced apart creases.

18. The method according to claim 15 wherein said forming of foldable tabs is such that the lengths of said first and second foldable tabs are less than the lengths of said third and fourth foldable tabs.

19. The method according to claim 15 wherein said providing roofing material further comprises providing asphalt composition material.

20. The method according to claim 15 wherein providing said roofing material further comprises providing fiberglass material.

21. The method according to claim 15 wherein providing said roofing material further comprises providing rubberized material.

22. The method according to claim 15 further comprising:

forming in said first sheet a first central tab integrally formed with said second end and having a width slightly less than the width of said first central portion; and forming in said second sheet a second central tab integrally formed with said fourth end and having a width slightly less than the width of said second central portion.

23. The method according to claim 22 wherein forming said first and second central tabs further comprises providing a pair of notches for indicating the required extent of overlap of one ridge cover by the adjacent ridge cover when installed on a ridge.

24. The method according to claim 22 wherein forming said first and second central tabs is such that said first central tab is longer than said second central tab.

25. The method according to claim 15 wherein providing the first and second sheets of roofing material is such that the first sheet of roofing material is substantially the same size as the second sheet of roofing material.

26. The method according to claim 15 wherein joining further comprises joining with an adhesive.

27. The method according to claim 26, the adhesive containing solid filler particles.

28. The method according to claim 27 wherein the solid filler particles include at least one of rubber particles, crushed rock, and ground roofing material.

29. A method of fabricating a number of ridge covers comprising:

providing a generally rectangular first sheet of roofing material, having a first top surface and an opposing first bottom surface;

providing a generally rectangular second sheet of roofing material, having a second top surface and an opposing second bottom surface and having a size substantially the same as the first sheet;

joining the first top surface to the second bottom surface to form a laminated sheet, wherein the sides of the first and the second sheet substantially coincide to form a first side and an opposing second side, and the laminated sheet further comprises said number of identical assemblies, each assembly having forward and rearward edges that coincides with the forward and rearward edges of the laminated sheet, two opposing sides substantially parallel to the sides of the laminated sheet, and a centerline midway between the two opposing sides;

forming said number of first foldable tabs integrally formed with said forward edge extending from proximate said number of centerlines toward said first side of the laminated sheet;

forming said number of second foldable tabs integrally formed with said forward edge extending from proximate said number of centerlines toward said second side of the laminated sheet;

folding said first and second foldable tabs such that said forward edge is proximate the bottom of said laminated sheet;

cutting said laminated sheet along the joined sides of adjacent assemblies to form said number of ridge covers with a forward end opposed to and having an increased thickness relative to said rearward end.

30. The method according to claim 29 wherein said folding of said first foldable tab and said second foldable tab is such that said first foldable tab and said second foldable tab are folded along a pair of spaced apart creases.

31. The method according to claim 29 wherein said providing roofing material further comprises providing asphalt composition material.

32. The method according to claim 29 wherein providing said roofing material further comprises providing fiberglass material.

33. The method according to claim 29 wherein providing said roofing material further comprises providing rubberized material.

34. The method according to claim 29 further comprising:

forming a central tab in each of said number of assemblies, each said central tab being integrally formed with said rearward end and having a width slightly less than the width of said assembly.

35. The method according to claim 34 wherein forming said central tabs further comprises providing a pair of notches for indicating the required extent of overlap of one ridge cover by the adjacent ridge cover when installed on a ridge.

36. The method according to claim 29 further comprising adding solid filler particles to the adhesive regions.

37. The method according to claim 36 wherein the solid filler particles include at least one of rubber particles, crushed rock, and ground roofing material.

38. The method of claim 29 wherein joining the first top surface to the second bottom surface further comprises joining the first top surface to the second bottom surface with the ends of the second sheet disposed forwardly of the corresponding ends of the first sheet to form a forward edge from one of the edges of the second sheet and a rearward edge from one of the edges of the first sheet.

39. The method of clain 29 wherein joining the first top surface to the second bottom surface further comprises joining the first top surface to the second bottom surface at said number of adhesive regions proximate said number of centerlines with an adhesive.

40. The ridge cover of claim 1 further comprising said third foldable tab folded into contact with a first portion of said first central portion and said fourth foldable tab folded into contact with a second portion of said first central portion.

41. The ridge cover of claim 1 further comprising said second longitudinal centerline being joined to said first longitudinal centerline with an adhesive.

42. The method of claim 15 wherein joining said first piece and said second piece further comprises joining said first piece and said second piece with said first end displaced inwardly from said third end, and said fourth end displaced inwardly from said second end.

43. The method of claim 15 further comprising joining said second longitudinal centerline to said first longitudinal centerline with an adhesive.

* * * * *